US006356030B2

(12) United States Patent
Itoh et al.

(10) Patent No.: US 6,356,030 B2
(45) Date of Patent: Mar. 12, 2002

(54) FLUORESCENT LUMINOUS TYPE DISPLAY DEVICE

(75) Inventors: Shigeo Itoh; Kazuo Iwasawa; Tatsuo Yamaura; Takao Kishino, all of Mobara (JP)

(73) Assignee: Futaba Denshi Kogyo Kabushiki Kaisha, Mobara (JP)

( * ) Notice: Subject to any disclaimer, the term of this patent is extended or adjusted under 35 U.S.C. 154(b) by 0 days.

(21) Appl. No.: 09/742,539

(22) Filed: Dec. 22, 2000

(51) Int. Cl.[7] ..... G09G 3/10

(52) U.S. Cl. ..... 315/169.1; 315/169.3; 345/74; 345/75; 345/55; 313/495; 313/496

(58) Field of Search ..... 315/169.1, 169.3, 315/169.4; 345/75, 76, 77, 80, 47, 55, 74; 313/495, 496

(56) References Cited

U.S. PATENT DOCUMENTS

| | | | | |
|---|---|---|---|---|
| 4,881,005 A | | 11/1989 | Morimoto et al. | 313/422 |
| 5,256,936 A | | 10/1993 | Itoh et al. | 313/495 |
| 5,589,738 A | | 12/1996 | Onodaka et al. | 315/169.1 |
| 5,633,650 A | | 5/1997 | Kishino et al. | 345/74 |
| 5,703,611 A | | 12/1997 | Kishino et al. | 345/74 |
| 5,717,286 A | | 2/1998 | Itoh et al. | 313/495 |
| 5,721,561 A | | 2/1998 | Kishino et al. | 345/75 |
| 5,786,795 A | | 7/1998 | Kishino et al. | 345/75 |
| 5,789,856 A | | 8/1998 | Itoh et al. | 313/495 |
| 5,872,420 A | | 2/1999 | Itoh et al. | 313/292 |
| 5,949,394 A | | 9/1999 | Kishino et al. | 345/74 |
| 5,986,624 A | * | 11/1999 | Ando et al. | 345/74 |
| 6,031,336 A | * | 2/2000 | Rumbaugh et al. | 315/169.3 |
| 6,100,637 A | | 8/2000 | Kishino et al. | 313/495 |
| 6,169,372 B1 | * | 1/2001 | Kobayashi et al. | 315/169.3 |
| 6,242,865 B1 | * | 6/2001 | Zimllich | 315/169.3 |

* cited by examiner

*Primary Examiner*—Don Wong
*Assistant Examiner*—Tuyet T. Vo
(74) *Attorney, Agent, or Firm*—Oblon, Spivak, McClelland, Maier & Neustadt, P.C.

(57) ABSTRACT

A flourescent luminous type display device capable of providing display at increased luminance while being simplified in structure. An insulating substrate constituting a vacuum airtight envelope is laminatedly formed on an inner surface thereof with cathode electrodes and emitters in order. Another insulating substrate is laminatedly formed on an inner surface thereof with an anode electrode and phosphor layers. The phosphor layers contain a secondary electron emission material. When a switch is closed, electron emitted from the emitters are permitted to be impinged on the phosphor layers, leading to luminescence thereof. The anode electrode merely has a pulse-like drive signal applied thereto through a capacitor, however, secondary electrons emitted from the phosphor layers permit the luminescence to be maintained even after stop of the drive signal.

9 Claims, 9 Drawing Sheets

Vcut = VG - (Vc + Vg) < Vth

FLUORESCENT LUMINOUS TYPE DISPLAY DEVICE

BACKGROUND OF THE INVENTION

This invention relates to a fluorescent luminous type display device, and more particularly to a fluorescent luminous type display device constructed so as to permit electrons emitted from a field emission type electron emitting material to be impinged on a phosphor, to thereby carry out luminous display.

Development of a fluorescent luminous type display device has been conventionally proceeded for applications to a graphic display device or the like. The fluorescent luminous type display device generally includes a vacuum airtight envelope in which anode electrodes each having a phosphor deposited thereon, Spindt-type field emission elements laminated on cathode electrodes, and lead-out electrodes arranged between the anode electrodes and the field emission cathodes are arranged.

In the conventional fluorescent luminous type display device for the graphic display device, the anode electrodes and cathode electrodes are arranged in a matrix-like manner. Thus, the anode electrodes and cathode electrodes are driven according to a simple matrix driving system wherein one electrodes of the anode electrodes and cathode electrodes are driven in order by means of a scanning signal and the other electrodes of the cathode electrodes and anode electrodes are driven depending on a display signal in synchronism with the driving of the one electrodes, resulting in luminous display being carried out.

Unfortunately, the simple matrix driving system described above, when it is incorporated in a graphic display device increased in the number of picture cells or the like, causes a drive circuit to be complicated in structure and a period of time for which each of the picture cells is driven to be reduced, leading to a failure to satisfactorily increase brightness or luminance of the luminous display.

In order to solve the problem, some techniques were proposed, which include application of a voltage as high as hundreds of volts to the anode electrodes, an active matrix drive system using a thin film transistor (TFT) or the like.

However, the former techniques are required to ensure insulation between the electrodes, resulting in being complicated in structure. The latter techniques are required to form the thin film transistor in correspondence to each of display picture cells.

SUMMARY OF THE INVENTION

The present invention has been made in view of the foregoing disadvantage of the prior art.

Accordingly, it is an object of the present invention to provide a fluorescent luminous type display device which is capable of providing display increased in brightness or luminance while being simplified in structure.

In accordance with the present invention, a fluorescent luminous type display device is provided. The fluorescent luminous type display device includes a vacuum airtight envelope including a first insulating substrate and a second insulating substrate arranged opposite to the first insulating substrate, at least one anode constituted by at least one anode electrode arranged on an inner surface of the first insulating substrate and at least one phosphor layer emitting secondary electrodes and laminatedly deposited on the anode electrode, at least one cathode electrode arranged on an inner surface of the second insulating substrate and at least one field electron emission material laminatedly arranged on the cathode electrode, at least one gate electrode arranged between the phosphor layer and the field electron emission material, and a drive circuit for driving each of the anode electrode, cathode electrode and gate electrode in response to a display signal. The drive circuit includes a means for driving the anode electrode, cathode electrode and gate electrode to cause electrons emitted from the field electron emission material to be impinged on the phosphor layer, leading to luminescence of the phosphor layer and then floating a potential at the anode electrode. The drive circuit applies a voltage at a predetermined level between the gate electrode and the cathode electrode to maintain luminescence of the phosphor layer.

Also, in accordance with the present invention, a fluorescent luminous type display device is provided. The fluorescent luminous type display device includes a vacuum airtight envelope including a first insulating substrate and a second insulating substrate arranged opposite to the first insulating substrate, at least one anode constituted by at least one anode electrode arranged on an inner surface of the first insulating substrate and at least one phosphor layer emitting secondary electrons and laminatedly deposited on the anode electrode, a plurality of cathode electrodes arranged on an inner surface of the second insulating substrate and a plurality of field electron emission materials laminatedly arranged on the cathode electrodes, at least one gate electrode arranged between the phosphor layer and the field electron emission materials so as to define a matrix in cooperation with the cathode electrodes, and drive circuits for driving the anode electrode, cathode electrodes and gate electrode. The drive circuits include a means for feeding a luminescence drive signal to the anode electrode for a predetermined period of time, feeding a scanning signal to one of the gate electrode and cathode electrodes for the predetermined period of time and feeding a luminescence drive signal to the other of the gate electrode and cathode electrodes in synchronism with the scanning signal.

Further, in accordance with the present invention, a fluorescent luminous type display device is provided. The fluorescent luminous type display device includes a vacuum airtight envelope including a first insulating substrate and a second insulating substrate arranged opposite to the first insulating substrate, at least one anode constituted by at least one anode electrode arranged on an inner surface of the first insulating substrate and at least one phosphor layer emitting secondary electrons and laminatedly deposited on the anode electrode, a plurality of cathode electrodes arranged on an inner surface of the second insulating substrate and a plurality of field electron emission materials laminatedly arranged on the cathode electrodes, a plurality of gate electrodes arranged between the phosphor layer and the field electron emission materials so as to define a matrix in cooperation with the cathode electrodes, and drive circuits for driving the anode electrode, cathode electrodes and gate electrodes. The drive circuits include a means for feeding a predetermined signal to the anode electrode, cathode electrodes and gate electrodes to carry out luminescence of the phosphor layer corresponding to all picture cells, and then carrying out feeding of a scanning signal to one electrodes of the gate electrodes and cathode electrodes and feeding of an erasing signal corresponding to a display signal to the other electrodes of the gate electrodes and cathode electrodes in synchronism with the scanning signal.

In a preferred embodiment of the present invention, the drive circuits feed the scanning signal to the one electrodes at times corresponding to maximum display gray scales and feed the erasing signal corresponding to display gray scales of the display signal to the other electrodes in synchronism with the scanning signal.

In a preferred embodiment of the present invention, a plurality of the anode electrodes are arranged. The anode electrodes each are arranged opposite to the one electrodes, respectively. The drive circuits include a means for applying an anode drive signal to the anode electrodes in order prior to feeding of the scanning signal to the one electrodes and carrying out feeding of a reset signal in conformity to misregistration in timing of the anode drive signal.

In a preferred embodiment of the present invention, the anode contains a secondary electron emission material capable of emitting secondary electrons therefrom.

In a preferred embodiment of the present invention, the secondary electron emission material contains at least one selected from the group consisting of BiO, PbO, MgO, SbO and SnO.

Further, in accordance with the present invention, a fluorescent luminous type display device is provided. The fluorescent luminous type display device includes a vacuum airtight envelope including a first insulating substrate and a second insulating substrate arranged opposite to the first insulating substrate, at least one anode constituted by at least one anode electrode formed on an inner surface of the first insulating substrate and at least one phosphor layer laminatedly formed on the anode electrode, at least one cathode electrode arranged on an inner surface of the second insulating substrate and at least one field electron emission material laminatedly arranged on the cathode electrode, and at least one gate electrode arranged between the phosphor layer and the field electron emission material. The anode contains a secondary electron emission material capable of emitting secondary electrons therefrom. The secondary electron emission material may contain at least one selected from the group consisting of BiO, PbO, MgO, SbO and SnO.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a fluorescent luminous type display device according to the present invention will be described hereinafter with reference to the accompanying drawings.

Figure 1:
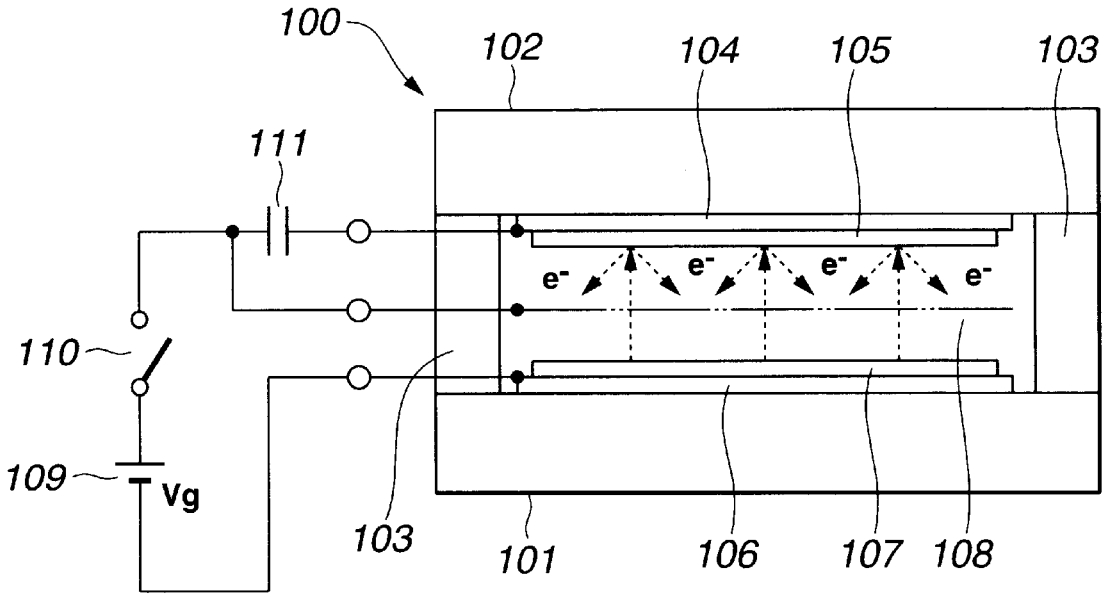
FIG. 1 is a schematic view showing a principle of a fluorescent luminous type display device according to the present invention.
Figure 2:
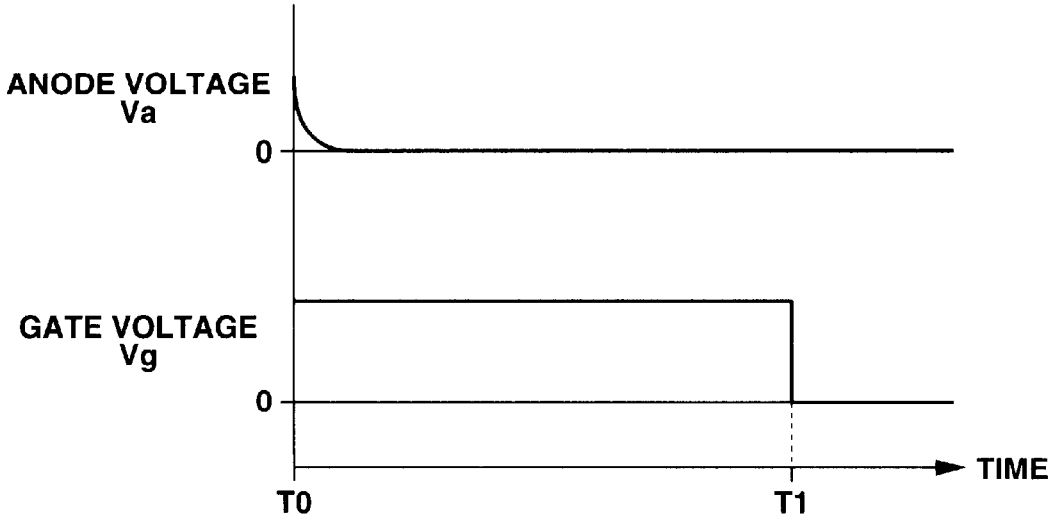
FIG. 2 is a timing chart showing a principle of a fluorescent luminous type display device according to the present invention.

Referring first to FIGS. 1 and 2, a principle of a fluorescent luminous type display device according to the present invention is illustrated, wherein FIG. 1 shows a drive circuit for the fluorescent luminous type display device of the present invention and FIG. 2 shows operation of the drive circuit.

In FIG. 1, a front substrate 102 made of glass and acting as a first insulating substrate, a rear substrate 101 made of glass and acting as a second insulating substrate, and an insulating seal glass material arranged between the front substrate 102 and the rear substrate 101 so as to sealedly join peripheries of both substrates to each other are arranged so as to cooperate with each other to provide a vacuum airtight envelope 100, which has a vacuum atmosphere formed therein by evacuation.

The rear substrate 101 has at least one cathode electrode 106 and emitters 107 deposited on an inner surface thereof in a laminated manner or laminatedly. The emitters 107 include carbon nanotubes made of field electron emission material capable of emitting electrons by an action of an electric field.

The front substrate 102 is laminatedly formed on an inner surface thereof with at least one light-permeable anode electrode 104 and at least one phosphor layers 105 in order. The anode electrode 104 and phosphor layer 105 cooperate together to provide an anode. The phosphor layer 105 is made of a phosphor containing a secondary electron increasing material having a secondary electron emitting ratio $\delta$ set within a range of 1 or less ($\delta \geqq 1$) in order to increase secondary electron emission or the amount of secondary electrons which the phosphor layer emits. Incorporation of the secondary electron increasing material into the phosphor layer 105 may be carried out by incorporation thereof into the phosphor or coating thereof on the phosphor. The secondary electron increasing material may be any one of materials capable of emitting secondary electrons including, for example, BiO, PbO, MgO, SbO, SnO and a combination thereof. Alternatively, the secondary electron emitting material may be incorporated in the anode electrode 104 rather than the phosphor layer 105.

The fluorescent luminous type display device of the illustrated embodiment also includes at least one mesh-like gate electrode 108 arranged between the phosphor layer 105 and the emitter 107.

The anode electrode 104 is connected through a capacitor 111 and an on-off switch 110 to a positive terminal of a DC power supply 109. The gate electrode 108 is connected through the switch 110 to the positive terminal of the DC power supply 109. Also, the cathode electrode 106 is connected to a negative terminal of the DC power supply. The DC power supply has an output voltage Vg set to be equal to or above a threshold voltage Vth which is a lowermost voltage which permits the emitters 107 to emit electrons.

FIG. 2 is a timing chart showing driving of the fluorescent luminous type display device shown in FIG. 1 by a drive circuit.

Now, operation of the fluorescent luminous type display device of the present invention will be described with reference to FIGS. 1 and 2.

First, when the switch 110 is closed at time To, the gate electrode 108 has the voltage Vg applied thereto from the DC power supply 109. This results in the drive voltage Vg which permits the emitters 107 to emit electrons being applied between the cathode electrode 106 and the gate electrode 108, leading to discharge of electrons from the emitters 107.

Concurrently, the anode electrode 104 has an anode voltage Va which is a positive signal obtained by differentiating a DC current applied thereto through the capacitor 111, so that a large part of the electrons emitted is impinged on the phosphor layer 105, to thereby be absorbed on the anode electrode 104. This permits the phosphor layer 105 to carry out luminescence.

At this time, when the phosphor layer 105 each has a secondary electron emitting ratio δ set to be 1 or less ($\delta \geqq 1$), it is permitted to emit electrons. In this instance, when the anode electrode 104 contains the secondary electron increasing material, it is permitted to emit them. The secondary electrons thus emitted travel to the gate electrode 108.

In such a state, even when a potential at the anode electrode 104 is floated or an anode switch (not shown) is turned off to cause the anode voltage Va to be extinguished, the anode electrode 104 is kept at substantially the same potential as the gate electrode 108 because the anode electrode 104 is kept connected to the gate electrode 108 at a predetermined impedance by electrons in the vacuum atmosphere.

Thus, electrons accelerated by the gate voltage Vg continue to travel toward the phosphor layer 105 and anode electrode 104, so that the phosphor layer 105 or anode electrode 104 may emit secondary electrons, which are then absorbed on the gate electrode 108 arranged in proximity thereto, resulting in the above-described operation may be maintained.

Thus, even after a potential at the anode electrode 104 is floated, the phosphor layer 105 is permitted to carry out luminescence while keeping luminance or brightness substantially unvaried. The luminance may be controlled by varying the gate voltage Vg applied to the gate electrode 108. Also, the above-described luminescence is maintained until a voltage between the gate electrode 108 and the cathode electrode 106 is reduced to a level lower than the above-described threshold voltage Vth, to thereby shield emission of electrons. For example, in FIG. 2, the luminescence is maintained until the gate voltage Vg is shut off at time T1.

More specifically, driving of the anode electrode 104 and gate electrode 108 at a positive voltage of a predetermined level with respect to the cathode electrode 106 permits the phosphor layer 105 to store a state prior to stop of the driving to keep the luminescence even when driving of the anode electrode 104 is stopped to float a potential at the anode electrode 104, once the phosphor layer 105 carries out luminescence. Thus, it will be noted that the phosphor layer 105 serves as a luminous element exhibiting a memory function.

The fluorescent luminous type display device of the present invention constructed as described above may be applied to a lamp which is activated by a single-shot pulse to maintain luminescence, an X-Y matrix display device and the like. In this instance, the fluorescent luminous type display device is permitted to possess a memory function for a one-frame, to thereby exhibit many advantages.

Also, it is possible to construct an observation equipment of a single-shot phenomenon in a manner to feed the anode electrode 104 with a one-shot electric pulse signal generated by an object to be observed (hereinafter referred to as "observed object") or a pulse signal obtained by converting a single-phenomenon of the observed object into an electric pulse while previously applying a voltage equal to or above the above-described threshold voltage Vth between the cathode electrode 106 and the gate electrode 108. Such construction permits the observation equipment to readily observe an instantaneous one-shot phenomenon of the observed object due to whether or not the phosphor layer 105 carried out luminescence which is not instantaneous but continuous.

FIGS. 1 and 2, as described above, show a principle of the fluorescent luminous type luminous device of the present invention. In the present invention, the emitters 107 each are merely required to be made of a field electric emission material which is capable of emitting electrons by an action of an electric field. For example, the emitters 107 each may be in the form of a Spindt-type emitter of a conical shape. Alternatively, it may be made of at least one carbon material selected from the group consisting of single-layer and multi-layer carbon nanotubes, carbon nanofibers, fullerenes, nanoparticles, nanocapsules and carbon nanohorns. Also, it may be made of a carbon thin film.

The gate electrode 108 may be made of a metal mesh material into a gate-like configuration. Alternatively, it may be constructed in any other suitable configuration or structure such as a rib-like shape or the like. Also, when the phosphor of the phosphor layer 105 or the anode electrode 104 per se has a desired secondary electron emission capacity (at least $\delta \geqq 1$) or is made of a secondary electron emission material, the secondary electron increasing material is not required.

Figure 3:
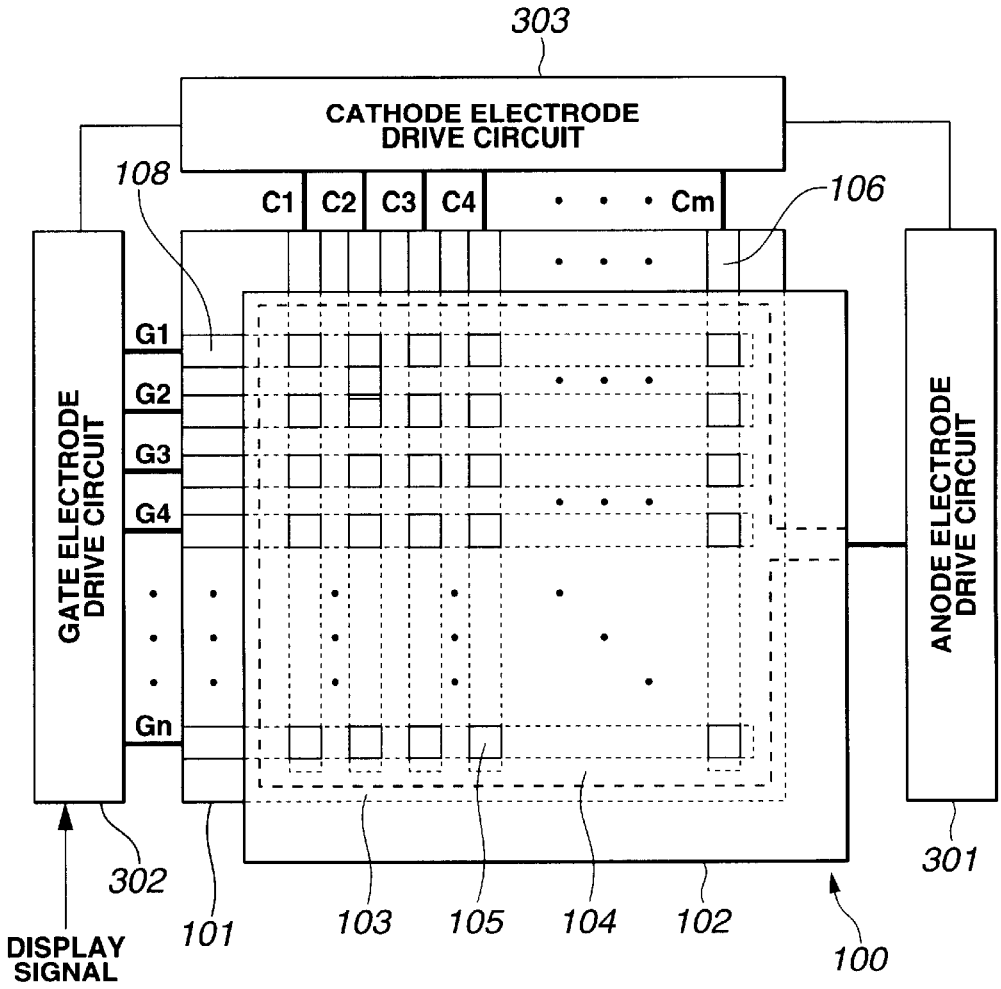
FIG. 3 is a block diagram showing a fluorescent luminous type display device according to an embodiment of the present invention.

Now, a fluorescent luminous type display device according to an embodiment of the present invention will be described with reference to FIG. 3, which is constructed into an X-Y matrix structure. In FIG. 3, reference numerals like those in FIG. 1 designate corresponding parts.

In FIG. 3, a front substrate 102 made of glass and acting as a first insulating substrate, a rear substrate 101 made of glass and acting as a second insulating substrate, and an insulating seal glass material arranged between the front substrate 102 and the rear substrate 101 so as to sealedly join peripheries of both substrates to each other are arranged so as to cooperate with each other to provide a vacuum airtight envelope 100, which is then evacuated at a vacuum, resulting in a vacuum atmosphere formed therein.

The rear substrate 101 is formed on an inner surface thereof with a plurality of strip-like cathode electrodes 106 and emitters (not shown) in a laminated manner or laminatedly. The emitters each are made of at least one carbon material selected from the group consisting of single-layer and multi-layer carbon nanotubes, carbon nanofibers, fullerenes, nanoparticles, nanocapsules and carbon nanohorns.

The front substrate 102 has a single light-permeable anode electrode 104 formed all over an inner surface thereof so as to extend over a whole display region thereof. The anode electrode 104 has phosphor layers 105 deposited thereon in a laminated manner or laminatedly. The anode electrode 104 and phosphor layers 105 cooperate together to provide anodes. At least one of the phosphor layers 105 and anode electrode 104 is made of a phosphor containing a secondary electron increasing material capable of increasing secondary electron emission or a phosphor having a secondary electron emitting ratio δ set to be 1 or more (δ≧1), or an electrode material containing a secondary electron increasing material capable of increasing secondary electron emission or an electrode material having a secondary electron emitting ratio δ set to be 1 or more (δ≧1). Thus, the anodes contain the second electron emission material.

The fluorescent luminous type display device of the illustrated embodiment also includes a plurality of mesh-like gate electrodes 108 arranged between the phosphor layers 105 and the emitters. The mesh-like gate electrodes 108 are made of a metal mesh material and formed into a strip-like shape. The cathode electrodes 106 and gate electrodes are arranged in a manner to be perpendicular to each other so as to define a matrix in cooperation with each other.

The anode electrode 104 is connected to an anode electrode drive circuit 301 and the cathode electrodes 106 are connected to a cathode electrode drive circuit 303. Also, the cathode electrodes 108 are connected to a gate electrode drive circuit 302. The gate electrode drive circuit 302 has a display signal fed or inputted thereto.

The anode electrode drive circuit 301, gate electrode drive circuit 302 and cathode electrode drive circuit 303 cooperate with each other to constitute a drive circuit, which is constructed so as to drive the anode electrode 104, gate electrodes 108 and cathode electrodes 106 in synchronism with each other. Alternatively, the illustrated embodiment may be constructed so as to feed the display signal to the cathode electrode drive circuit 303 rather than the gate electrode drive circuit 302.

Figure 4:
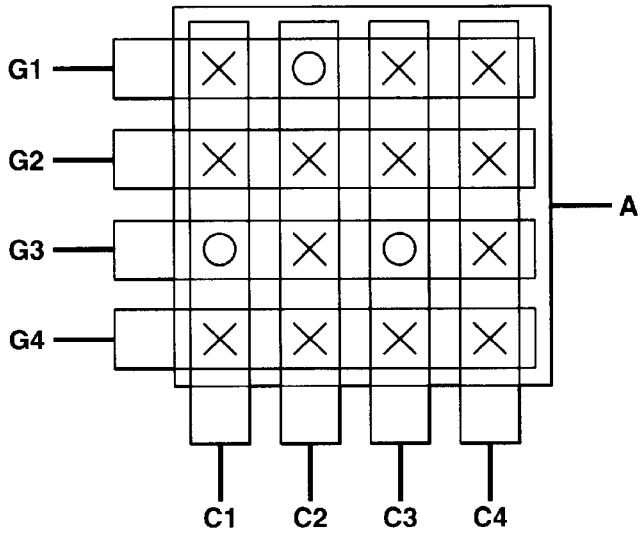
FIG. 4 is a schematic view showing a first embodiment of a fluorescent luminous type display device according to the present invention.
Figure 5:
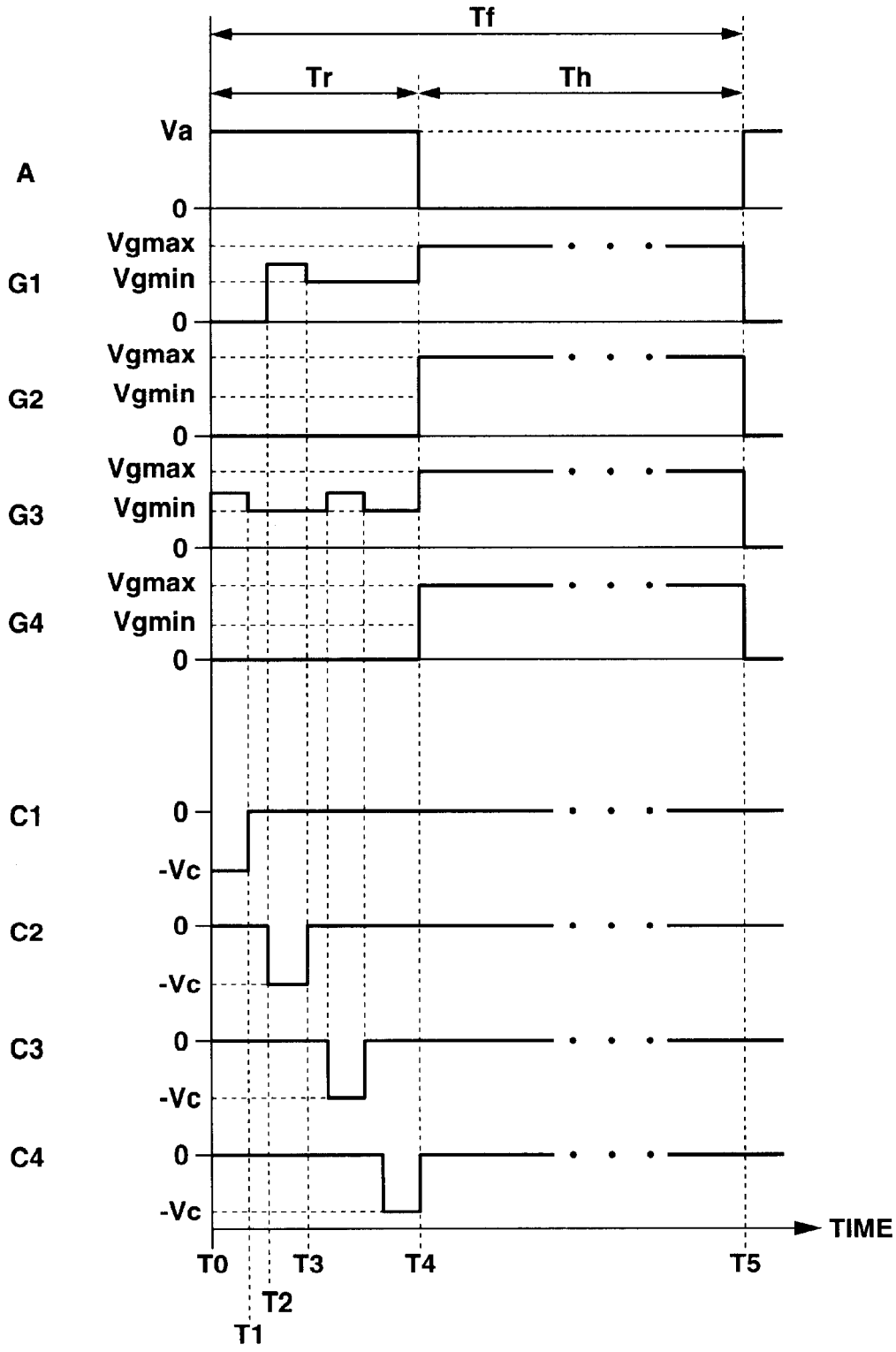
FIG. 5 is a timing chart of the fluorescent luminous type display device shown in FIG. 4.

Referring now to FIGS. 4 and 5, a first embodiment of a fluorescent luminous type display device according to the present invention is illustrated, wherein FIG. 4 is a schematic view of a fluorescent luminous type display device of the illustrated embodiment and FIG. 5 is a timing chart thereof. The fluorescent luminous type display device of the illustrated embodiment is constructed so as not to have any gray scale or gradation. In FIG. 4, the fluorescent luminous type display device is shown so as to have only sixteen (16) picture cells (four rows×four columns) for clarity in the description. In FIG. 4, strip-like gate electrodes G1 to G4 are arranged so as to form four rows and strip-like cathode electrodes C1 to C4 are arranged so as to form four columns. Also, a single anode electrode A is arranged all over a display region. The gate electrodes G1 to G4 and cathode electrodes C1 to C4 are arranged in a manner to be perpendicular to each other so as to define a matrix in cooperation with each other.

In FIG. 4, ○ indicates picture cells which are driven for luminescence and × indicates picture cells which are not driven for luminescence. Now, operation of subjecting picture cells to driving for luminescence shown in FIG. 4 will be described with reference to FIG. 5.

Basically, the operation is so carried out that under the conditions that a one-frame period Tr is constituted by a write period Tr and a hold period Th, the picture cells are driven for luminescence in response to a display signal during the write period Tr, luminescence/non-luminescence of the picture cells obtained in the write period Tr are maintained during the hold period Th and all picture cells are reset to an initial state at the end of the frame period Tf.

More specifically, a drive signal at a predetermined voltage level is fed or applied to the anode electrode A from an anode electrode drive circuit for a predetermined period of time during the write period Tr and then a potential at the anode electrode A is floated, so that a scanning signal is successively fed or applied to the cathode electrodes C1 to C4 from a cathode electrode drive circuit during the write period Tr and a drive signal for luminescence corresponding to a display signal is fed to the gate electrodes G1 to G4 from a gate electrode drive circuit in synchronism with the scanning signal. This results in picture cells corresponding to the display signal carrying out luminescence for display in order. Then, a state obtained at the end of the write period Tr is maintained during the hold period Th. Subsequently, all picture cells are reset to the initial state at which they are kept from emitting light at the end of the hold period Th or the end of the frame period Tf.

Now, the operation described above will be described in detail.

First of all, at time T0, a luminescence drive signal Va at a level sufficient for driving for luminescence is applied to the anode electrode A from the anode electrode drive circuit during the write period Tr. In synchronism with application of the luminescence drive signal, the cathode electrode C1 is fed with a scanning signal at a voltage −Vc from the cathode electrode drive circuit and the gate electrode G3 is fed with a luminescence drive signal Vg at a voltage Vg from the gate electrode drive circuit. The voltage Vg is set to be equal to or above a threshold voltage Vth which is a lowermost voltage which permits the emitters to emit light and is between Vgmin and Vgmax.

This permits a picture cell positioned on the row corresponding to the gate electrode G3 on the column of the cathode electrode C1 to emit light and picture cells positioned on rows corresponding to the gate electrodes G1, G2 and G4 on the column of the cathode electrode C1 to fail to emit light. Then, at time T1, a drive voltage at the gate voltage G3 is held at Vgmin which is a lowermost voltage required for maintaining the above-described luminescence, so that luminescence of picture cells in a region interposed between the cathode electrode C1 and gate electrode G3 may be kept.

Then, at time T2, the cathode electrode C2 has a scanning signal at a voltage −Vc fed or applied thereto from the cathode electrode drive circuit and the gate electrode G2 is fed with a luminescence drive signal Vg from the gate electrode drive circuit in response to a display signal in synchronism with application of the scanning signal. This permits picture cells positioned on the column corresponding to the gate electrode G1 on the row of the cathode C2 to emit light while keeping picture cells on the rows corresponding to the gate electrodes G2 to G4 on the row of the cathode C2 from emitting light. Then, at time T3, a drive voltage at the gate voltage G1 is held at Vgmin which is a lowermost voltage required to maintain the luminescence described above. This results in luminescence of picture cells interposed between the cathode electrode C2 and gate electrode G1 being carried out and maintained.

Subsequently, in a period of time between time T3 and time T4, substantially the same operation as described above is carried out, so that luminescence of picture cells in a region interposed between the cathode electrode C3 and the gate electrode G3 may be carried out and maintained. Also, picture cells corresponding to the cathode electrode C4 are kept from emitting light. This permits the picture cells corresponding to the display signal to carry out luminescence for display.

Thereafter, during a hold period Th starting at time T4, a voltage applied to each of the gate electrodes G1 to G4 is kept at a level of a maximum voltage Vgmax. This permits the picture cells emitting light for display to be increased in luminance or brightness, so that the display may be entirely increased in luminance. Thus, at the time when on/off operation of the gate electrodes G1 to G4 is carried out, the operation is carried out at a low voltage Vg, so that the driving for luminescence may be accomplished by means of a switching element relatively reduced in capacity.

Then, at time T5, all gate electrodes G1 to G4 are driven at a ground potential, to thereby cause whole display to be reset, resulting in luminescence of all picture cells being stopped, so that the one-frame period Tf may be terminated. Then, the above-described operation is repeated, so that luminous display corresponding to the display signal may be carried out for every frame.

When color display is desired, the anode electrode A has a plurality of phosphors different in color from each other deposited thereon in a manner like strips or dots parallel to the gate electrodes G1 to G4 while being classified by color. Then, the gate electrodes G1 to G4 each are fed with a display signal corresponding to the color display.

Figure 6:
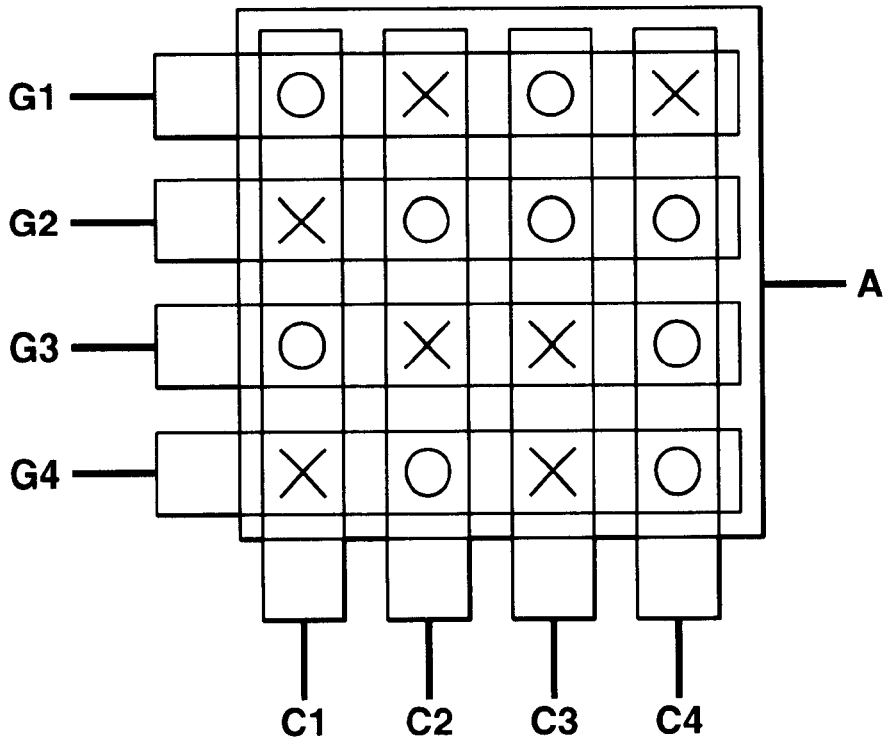
FIG. 6 is a schematic view showing a second embodiment of a fluorescent luminous type display device according to the present invention.
Figure 7:
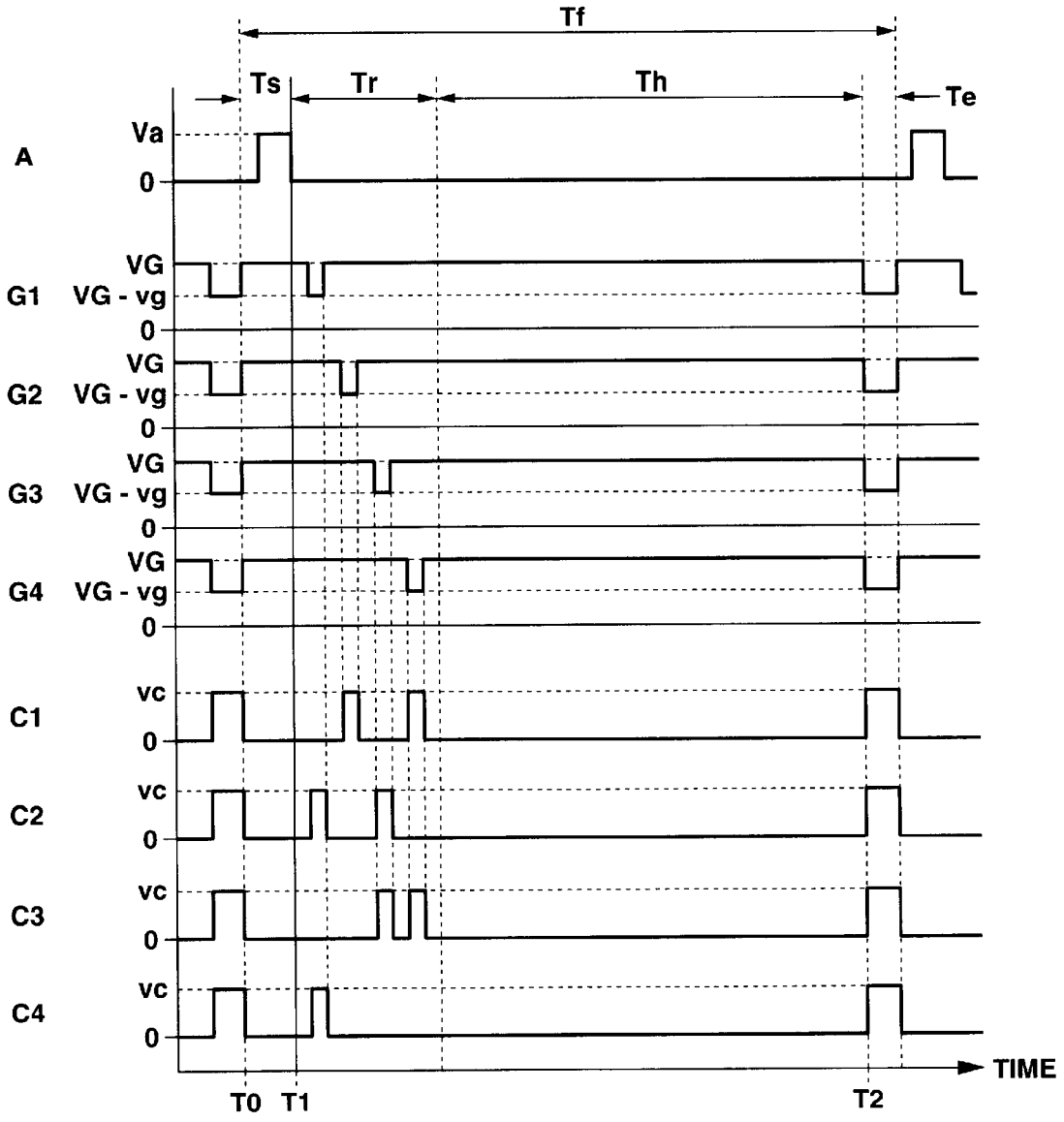
FIG. 7 is a timing chart of the fluorescent luminous type display device shown in FIG. 6.

Referring now to FIGS. 6 and 7, a second embodiment of a fluorescent luminous type display device according to the present invention is illustrated, wherein FIG. 6 is a schematic view of a fluorescent luminous type display device of the illustrated embodiment and FIG. 7 is a timing chart thereof. The fluorescent luminous type display device of the illustrated embodiment is constructed so as not to have any gray scale or gradation. In FIG. 6, the fluorescent luminous type display device is shown so as to have only sixteen (16) picture cells (four rows×four columns) for clarity in the description.

Thus, in FIG. 6, strip-like gate electrodes G1 to G4 are arranged so as to form four rows and strip-like cathode electrodes C1 to C4 are arranged so as to form four columns. Also, a single anode electrode A is arranged over a whole display region. The gate electrodes G1 to G4 and cathode electrodes C1 to C4 are arranged in a manner to be perpendicular to each other so as to define a matrix in cooperation with each other.

In FIG. 6, ○ indicates picture cells which are driven for luminescence and × indicates picture cells which are not driven for luminescence. Now, operation of subjecting the picture cells to driving for luminescence will be described with reference to FIG. 7.

Basically, the operation is carried out in such a manner that under the conditions that a one-frame period Tr is constituted by a start period Ts, a write period Tr, a hold period Th and a reset period Te, all picture cells are once subjected to luminous display, the picture cells each are driven for luminescence in response to a display signal during the write period Tr, luminescence/non-luminescence of the picture cells obtained at the end of the write period Tr are held during the hold period Th and then all picture cells are reset to an initial state or a state of non-luminescence during the reset period Te.

More specifically, first of all, all picture cells are subjected to luminous display. Then, the gate electrodes G1 to G4 each are fed with a row discrimination timing signal and the cathode electrodes C1 to C4 each have a luminescence drive signal corresponding to a display signal inputted thereto in synchronism with the row discrimination timing signal. This causes luminescence of picture cells at which the row discrimination timing signal and luminescence drive signal coincide with each other to be erased. A state of each of the picture cells of which luminescence has not been erased and those of which luminescence has been erased is maintained during the one-frame period and then rewritten into the next frame. This permits luminous display corresponding to the display signal to be carried out. In this instance, gradated or contrasted display may be carried out as described below.

First, in the start period Ts beginning at time T0, a start pulse signal Va acting as a luminescence drive signal is fed to the anode electrode A from an anode electrode drive circuit for a predetermined period of time and a potential at the anode electrode A is floated, so that an on-level signal VG which is equal to or above a threshold voltage Vth is fed to all gate electrodes G1 to G4 from a gate electrode drive circuit and all cathode electrodes C1 to C4 are pulled down to a zero level by a cathode electrode drive circuit. This permits all picture cells to be driven for luminescence once.

Then, in the write period Tr starting at time T1, a gate discrimination timing pulse (scanning signal) of VG-Vg in voltage is fed to the gate electrodes G1 to G4 in order at predetermined intervals. The cathode electrodes C1 to C4 are fed with an erasing pulse signal Vc which corresponds to the display signal and acts as an erasing signal for erasing luminescence of the picture cells in synchronism with the gate discrimination timing pulse.

In FIG. 6, in connection with the row of the gate electrode G1, luminescence of picture cells on the columns corresponding to the cathode electrodes C1 and C3 and non-luminescence of picture cells on the columns corresponding to the cathode electrodes C2 and C3 are maintained, so that application of the erasing pulse Vc to the cathode electrodes C2 and C4 may be carried out in synchronism with a timing of the gate discrimination timing pulse applied to the gate electrode G1.

Then, on the row of the gate electrode G2, the erasing pulse Vc is applied to only the cathode electrode C1 in conformity to a timing of the gate discrimination timing pulse applied to the gate electrode G2. Thus, on the row of the gate electrode G2, picture cells on the row corresponding to the cathode electrode C1 are rendered non-luminous and picture cells on the rows corresponding to the cathode electrodes C2 and C3 are rendered are permitted to carry out luminescence.

Likewise, the gate electrodes G3 and G4 and cathode electrodes C1 to C4 are driven in order. Thus, on the row of the gate electrode G3, picture cells on the columns corresponding to the cathode electrodes C1 and C4 are permitted to emit light. Also, on the row of the gate electrode G4, picture cells on the columns corresponding to the cathode electrodes C2 and C4 are permitted to carry out luminescence.

Thus, when the write period Tr is terminated, the display thus obtained is maintained or held during the hold period Th. After a lapse of the write period Tr, all picture cells are reset to the initial state or non-luminescence state during the reset period Te. Such arrangement of the reset period Te at the end of each of the frames ensures more positive operation in the next frame.

When color display is desired, the anode electrode A has a plurality of phosphors different in color from each other deposited thereon in a manner like strips or dots parallel to the cathode electrodes C1 to C4 while being classified by color. Then, the cathode electrodes C1 to C4 each are fed with a display signal corresponding to the color display.

Figure 8:
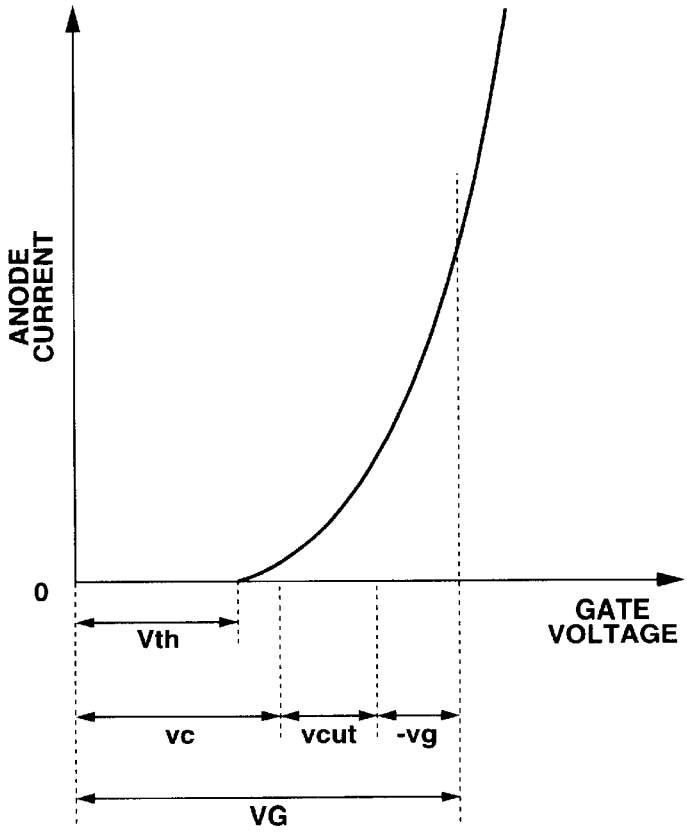
FIG. 8 is a schematic view of the fluorescent luminous type display device shown in FIG. 6.

In the illustrated embodiment, selection of a crest value of each of the voltages Vg, Vc and the like is essential. FIG. 8 shows gate voltage-anode current characteristics of the fluorescent luminous type display device, wherein relationship among the gate operation voltage VG, threshold voltage Vth, gate discrimination timing pulse voltage Vg and erasing pulse voltage Vc is indicated. The relationship is required to be so set that a voltage Vcut for stopping luminescence meets the following expression:

$$Vcut=VG-(Vc+Vg)<Vth.$$

In the illustrated embodiment, the cathode electrodes C1 to C4 are arranged with respect to all gate electrodes G1 to G4 in common, therefore, the gate discrimination timing pulse voltage Vg functions to discriminate that the display signal inputted to the cathode electrodes C1 to C4 should be written into which gate electrode(s) of the gate electrodes G1 to G4 or determine that picture cells corresponding to which gate electrode(s) of the gate electrodes G1 to G4 should be rendered non-luminous. However, an excessive increase in gate discrimination timing pulse voltage Vg leads to a possibility of causing the luminescence to be erased by only the gate discrimination timing pulse voltage Vg or causing flickering in the luminescence, to say the least. Thus, the gate discrimination timing pulse voltage Vg is preferably as low as possible within a range which permits discrimination of the gate voltages G1 to G4.

This is likewise true of the erasing pulse voltage Vc applied to the cathode electrodes. An excessive increase in crest value of the erasing pulse voltage above the threshold voltage Vth leads to a possibility of causing flickering in the luminescence. Thus, it is preferably as low as possible within a range which permits it to meet the above-described expression.

Also, with regard to the write period Tr, an increase in ratio for which the write period Tr accounts of one-frame often causes a difference in luminance or brightness due to a difference in lighting time among the gate electrodes G1 to G4. Thus, the write period Tr is preferably as short as possible.

Figure 9:
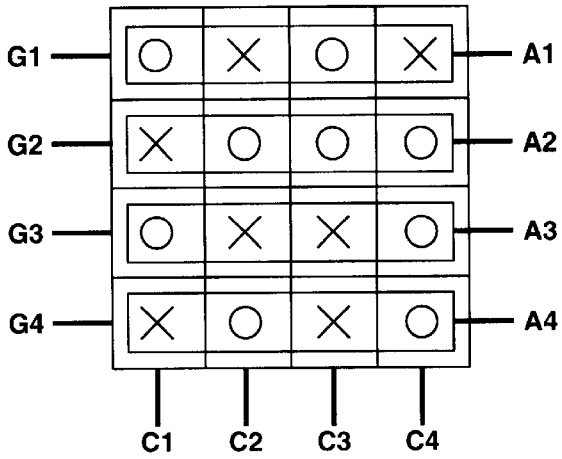
FIG. 9 is a schematic view showing a third embodiment of a fluorescent luminous type display device according to the present invention.
Figure 10:
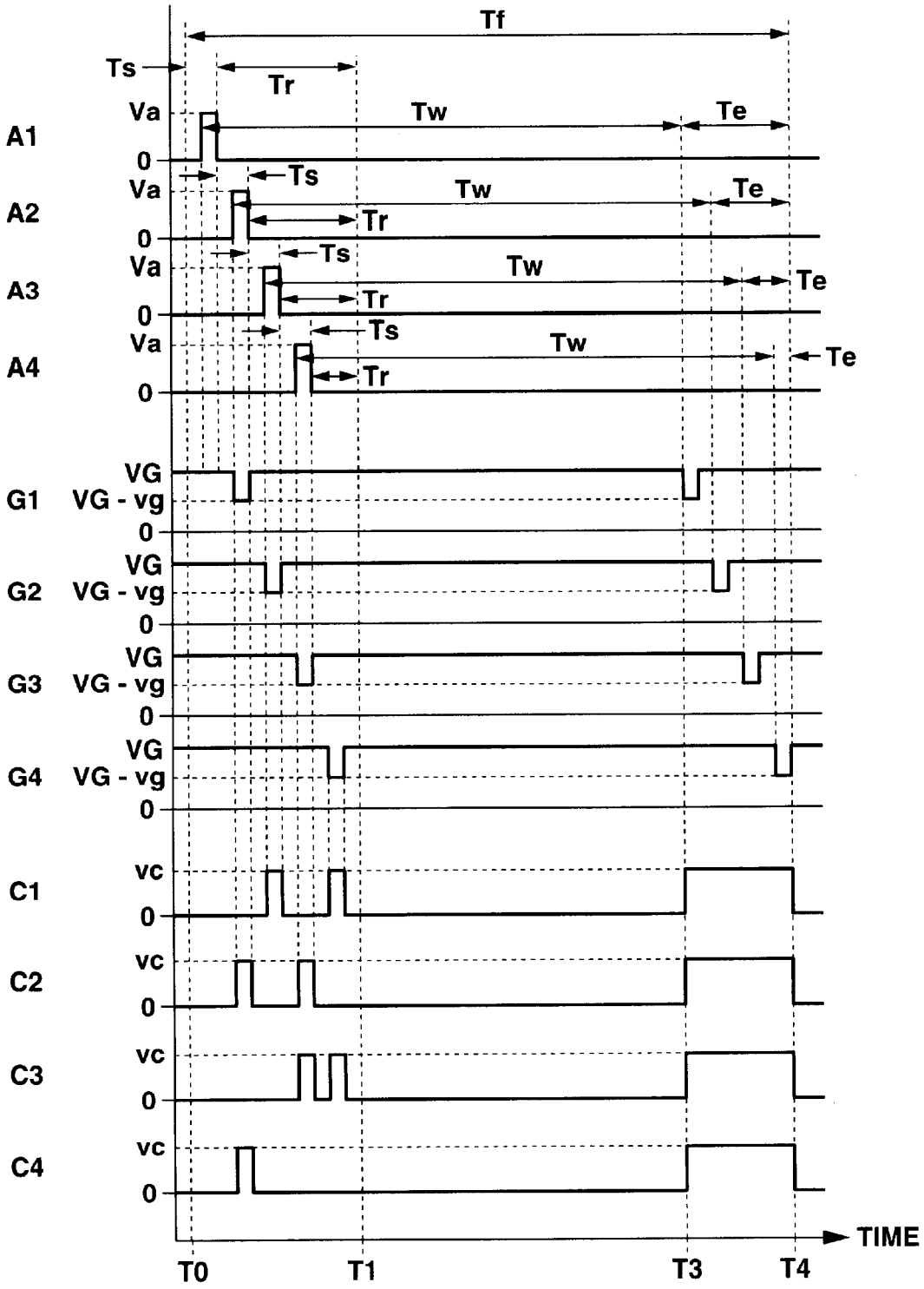
FIG. 10 is a timing chart of the fluorescent luminous type display device shown in FIG. 9.

Referring now to FIGS. 9 and 10, a third embodiment of a fluorescent luminous type display device according to the present invention is illustrated, which is configured so as to eliminate the above-described problem.

A fluorescent luminous type display device of the illustrated embodiment includes a plurality of anode electrodes A1 to A4 arranged in a strip-like manner while being opposite to gate electrodes G1 to G4 and in parallel to the gate electrodes G1 to G4, unlike the single anode electrode in each of the embodiments described above.

In the illustrated embodiment, driving for luminescence is carried out by subjecting all picture cells to luminescence in order while carrying out shifting for a predetermined period of time for every row and then driving the picture cells for luminescence for every row in response to a display signal. Then, at the time when each frame is terminated, all picture cells are reset to an initial state or a state of non-luminescence by carrying out shifting at predetermined time intervals for every row. This permits a period of time for which the picture cells on each row carry out luminescence to be rendered uniform, to thereby prevent a difference in luminance among the picture cells.

Now, the manner of operation of the display device of the illustrated embodiment will be described in detail.

First, a start period Ts is provided which is shifted for a predetermined period of time for every row while setting time T0 as a starting point. Within the start period Tr for every row, a luminescent drive signal Va at a voltage Va is applied to corresponding anode electrodes A1 to A4 for a predetermined period of time within the start period for every row. Then, a potential at the anode electrodes is floated and synchronously a luminescence drive signal Vg is applied to the corresponding gate electrodes G1 to G4. This results in all picture cells being subjected to luminous display while carrying out shifting for the above-described predetermined period of time for every row.

Then, in the write period Tr lasting or extending to time T1, a gate discrimination timing pulse (scanning signal) having a voltage (VG−Vg) is applied to the corresponding gate electrodes G1 to G4 for a predetermined period of time in turn for every row. In synchronism with application of the gate discrimination timing pulse, the cathode electrodes C1 to C4 have an erasing pulse signal Vc corresponding to a display signal applied thereto in parallel. This permits picture cells corresponding to the display signal to carry out luminescence and picture cells of which luminescence is not required to be turned off.

During a reset period beginning at time T3, the gate electrode G1 has a reset signal applied or fed thereto and likewise all cathode electrodes C1 to C4 have the reset signal applied thereto. This causes luminescence of picture cells on the row of the gate electrode G1 to be stopped. Then, the reset signal is applied to the gate electrode G2 and likewise all cathode electrodes C1 to C4 have the reset signal applied thereto. This causes luminescence of picture cells on the rows of the gate electrodes G3 and G4 to be stopped, resulting in a one-frame period being terminated.

In the operation described above, maximum luminescence time is defined between application of the luminescence drive signal to the anode electrodes A1 to A4 and application of the reset signal. The time, which is indicated at Tw, is permitted to be equal to each other among the rows. This prevents a difference in luminance or brightness between the picture cells due to a variation in write period Tr.

In the illustrated embodiment, the anode electrodes A1 to A4 each are arranged so as to correspond to each of the gate electrodes G1 to G4. Alternatively, a plurality of anode electrodes each may be arranged in a manner to correspond to a plurality of gate electrodes.

Figure 11:
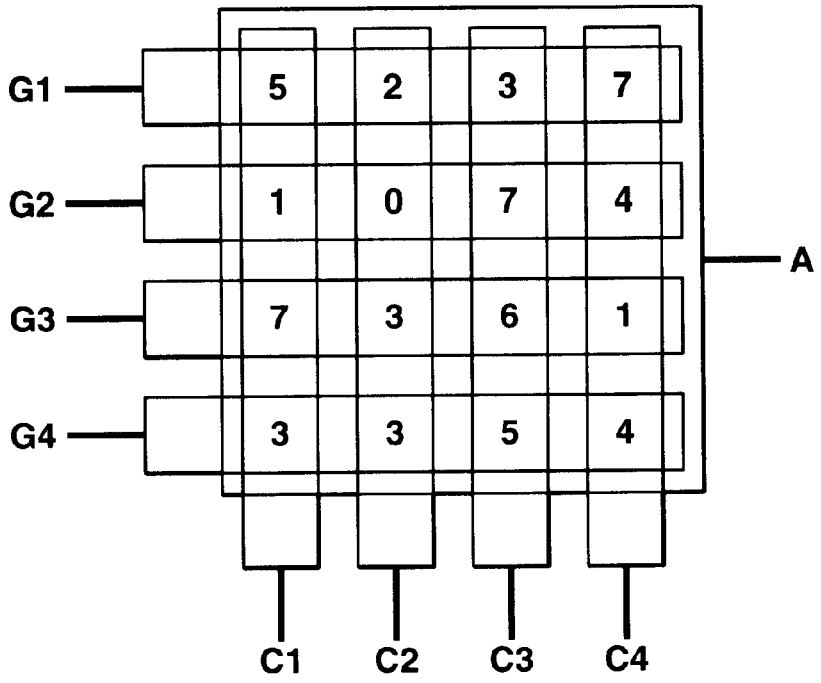
FIG. 11 is a schematic view showing a fourth embodiment of a fluorescent luminous type display device according to the present invention.
Figure 12:
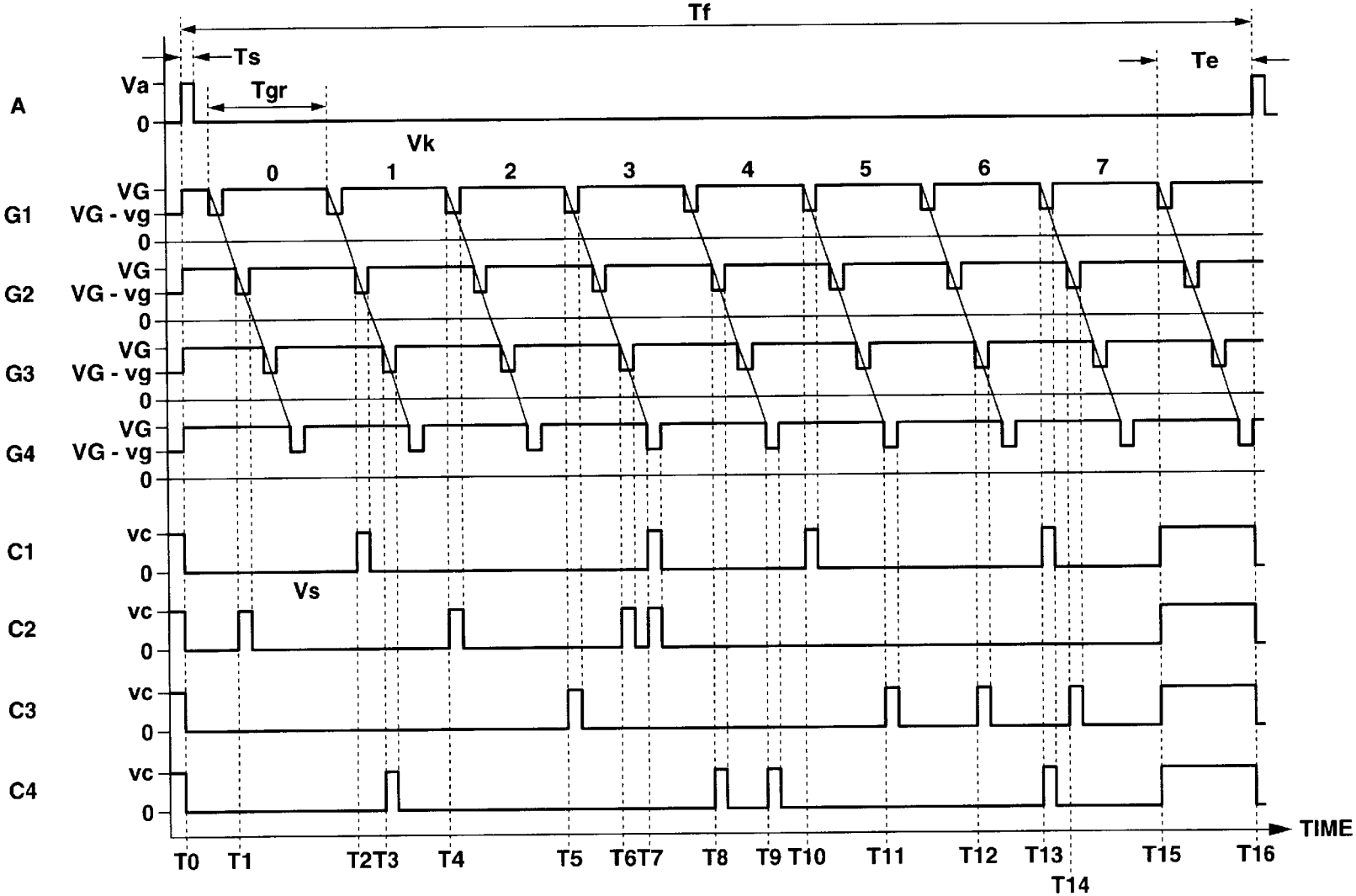
FIG. 12 is a timing chart of the fluorescent luminous type display device shown in FIG. 11.

Referring now to FIGS. 11 and 12, a fourth embodiment of a fluorescent luminous type display device according to the present invention is illustrated, wherein FIG. 11 is a schematic view of a fluorescent luminous type display device of the illustrated embodiment and FIG. 7 is a timing chart thereof. The fluorescent luminous type display device of the illustrated embodiment is constructed so as to carry out gradated display. In FIG. 11 as well, the fluorescent luminous type display device is shown so as to have only sixteen (16) picture cells (four rows×four columns) for clarity in the description, as in the embodiment shown in FIG. 3.

More particularly, in FIG. 11, four strip-like gate electrodes G1 to G4 are arranged so as to form four rows and four strip-like cathode electrodes C1 to C4 are arranged so as to form four columns. Also, a single anode electrode A is arranged so as to extend all over a display region. Further, gate electrodes G1 to G4 and cathode electrodes C1 to C4 are arranged in a manner to be perpendicular to each other so as to define a matrix in cooperation with each other.

Also, in FIG. 11, numerical values indicated on intersections (picture cells) between the gate electrodes G1 to G4 and the cathode electrodes C1 to C4 each indicate the number of gray scales. In the illustrated embodiment, the maximum number of display gray scales is defined to be eight (8). In FIG. 12, the gate electrode G1 is assigned eight numerical values "0" to "7", which are corresponds to the maximum gray scales.

Basic operation is carried out in substantially the same manner as the second embodiment described above, except that k timing pulses (scanning signals) Vk corresponding to the number of gray scales k (k=8 in the illustrated embodiment) within a one-frame period Tf are fed or applied to each of the gate electrodes G1 to G4. In synchronism with the timing pulses Vk, an erasing pulse is applied to the cathode electrodes C1 to C4 in parallel depending on a display signal, to thereby control lighting time depending on gray scales of the display signal, resulting in gradated display being carried out.

Now, operation of the embodiment shown in FIGS. 11 and 12 will be further described in detail. First of all, during a start period Ts starting at time T0, a start pulse Va having a voltage Va is applied to the anode electrode A from an anode electrode drive circuit for a predetermined period of time and then a potential at the anode electrode is floated. Also, a luminescence drive signal which has a voltage VG and is equal to or above a threshold voltage Vth is applied to all gate electrodes G1 to G4 from a gate electrode drive circuit and all cathode electrodes C1 to C4 are pulled down to a zero level by a cathode electrode drive circuit. This permits all picture cells to be driven for luminescence once.

In each of gray scale periods Tgr, the gate electrodes G1 to G4 are permitted to generate gray scale pulses Vk shifted in timing by a predetermined period of time, to thereby be discriminated. The predetermined period of time is indicated to be Tgr/n, wherein n is the number of rows. In the illustrated embodiment, n is 4. The gray scale pulse Vk is a signal having a voltage ($V_G$−Vg). Concurrently, in synchronism with the gray scale pulses Vk, an erasing signal Vs having a voltage Vc is applied to the cathode electrodes C1 to C4 at timings corresponding to the number of gray scales. This permits gradated display to be carried out.

Also, when the gray scale pulse Vk is applied to the gate electrode G2 at time T2, the erasing pulse Vs is applied to the cathode electrode C1 in response to a display signal in synchronism with application of the gray scale pulse. This permits a picture cell arranged at an intersection between the gate electrode G2 and the cathode electrode C1 to be driven at a gray scale number "1".

Similarly, between time T3 and time T4, each of the gate electrodes G1 to G4 and each of the cathode electrodes C1 to C4 are fed with the gray scale pulse Vk and erasing pulse Vs, respectively, so that gradated display corresponding to the display signal may be carried out.

At time T14, when the gray scale pulse Vk is applied to the gate electrode G2, an erasing pulse Vs is applied to the cathode electrode C3 in response to a display signal in synchronism with application of the gray scale pulse Vk. This results in a picture cell arranged at an intersection between the gate electrode G2 and the cathode electrode C3 being driven at a gray scale number "7".

Then, in a reset period Te between time T15 and time T16, a reset signal of a voltage Vc is applied to the cathode electrodes C1 to C4, so that the gray scale pulse Vk (reset signal) applied to the gate electrodes G1 to G4 during the reset period Te permits the above-described picture cells to be reset, leading to non-luminescence. This results in the one-frame period Tf being terminated.

Thereafter, the above-described operation is repeated, so that gradated display corresponding to the display signal may be carried out.

When color display is desired, the anode electrode A has a plurality of phosphors different in color from each other deposited thereon in a manner like strips or dots parallel to the cathode electrodes C1 to C4 while being classified by color. Then, the cathode electrodes C1 to C4 each are fed with a display signal corresponding to the color display.

As described above, the fluorescent luminous type display device of one embodiment of the present invention includes the envelope 100 including the insulating substrate 102 and the insulating substrate 101 arranged opposite to the insulating substrate 102, the anode constituted by the anode electrode 104 formed on the inner surface of the insulating substrate 102 and the phosphor layers 105 laminatedly deposited on the anode electrode 104, the cathode electrodes 106 and field electron emission materials 107 laminatedly arrangement on the inner surface of the insulating substrate 101, and the gate electrodes 108 arranged between the phosphor layers 105 and the field electron emission materials 107. At least one of the phosphor layers 105 and anode electrode 104 is made of a secondary electron emission material or contains the secondary electron emission material having at least one of BiO, PbO, MgO, SbO and SnO added thereto. The anode (or at least one of the phosphor layers 105 and/or anode electrode 104) is formed so as to have a secondary electron emitting ratio δ of 1 or less (δ≧1). Such construction permits the fluorescent luminous type display device to exhibit a memory function, so that it may provide a storage light emitter reacting on a single-shot phenomenon while keeping a structure of a circuit therefor simplified. Also, when the fluorescent luminous type display device of the embodiment is applied to X-Y matrix image display, it exhibits increased luminance at a reduced voltage while being simplified in structure without employing a complicated structure as in a conventional active matrix system, high-voltage drive system or the like, because the fluorescent luminous type display device may have a memory for one frame. Further, the fluorescent luminous type display device may be constructed at a reduced cost. In addition, the memory function permits the display device of the embodiment to readily obtain a temporary still picture from an animation.

Also, the fluorescent luminous type display device of one embodiment of the present invention includes a vacuum airtight envelope 100 including an insulating substrate 102 and an insulating substrate 101 arranged opposite to the insulating substrate 102, the anode electrode 104 arranged on the inner surface of the insulating substrate 102 and the phosphor layer 105 laminatedly deposited on the anode electrode 104, the cathode electrodes 106 arranged on the inner surface of the insulating substrate 101 and the field electron emission materials 107 laminatedly arranged on the cathode electrodes 106, the gate electrodes 108 arranged between the phosphor layers 105 and the field electron emission materials 107, and the drive circuit for driving the anode electrode 104, cathode electrodes 106 and gate electrodes 108 in response to a display signal. The drive circuit includes the anode electrode drive circuit 301, gate electrode drive circuit 302 and cathode electrode drive circuit 303. Driving of the anode electrode 104, cathode electrodes 106 and gate electrodes 108 by the drive circuit permits electrons emitted from the field electron emission materials 107 to be impinged on the phosphor layers 105, leading to luminescence of the phosphor layers 105. Then, driving of the anode electrode 104 is stopped, to thereby float a potential at the anode electrode and application of a voltage at a predetermined level between the gate electrodes 108 and the cathode electrodes 106 permits the luminescence to be maintained. At least one of the phosphor layers 105 and anode electrode 104 is made of a secondary electron emission material or contains the secondary electron emission material having at least one of BiO, PbO, MgO, SbO and SnO added thereto. The anode (or at least one of the phosphor layers 105 and/or anode electrode 104) is formed so as to have a secondary electron emitting ratio δ of 1 or less (δ≧1).

Such construction permits the fluorescent luminous type display device to provide a storage light emitter reacting on a single-shot phenomenon while keeping a structure of a circuit therefor simplified. Also, it permits the fluorescent luminous type display device of the embodiment to exhibit increased luminance at a reduced voltage while being simplified in structure. Further, the fluorescent luminous type display device may be constructed at a reduced cost. In addition, the memory function permits the display device of the embodiment to readily obtain a temporary still picture from an animation.

Further, the fluorescent luminous type display device of one embodiment of the present invention includes the plural cathode electrodes 106 and the anodes arranged so as to define a matrix in cooperation with the cathode electrodes 106 and having a secondary electron emitting ratio of $\delta \geqq 1$, the gate electrodes 108 arranged between the phosphor layers 105 and the field electron emission materials 107, and the drive circuit for driving each of the anode electrode 104, cathode electrodes 106 and gate electrodes 108. The drive circuit feeds a luminescence drive signal to the anode electrode 104 for a predetermined period of time. Also, the drive circuit feeds a scanning signal to one electrodes of the gate electrodes and cathode electrodes for the predetermined period of time and feeds a luminescence drive signal to the other electrodes of the gate electrodes and cathode electrodes in synchronism with the scanning signal. Such construction permits the fluorescent luminous type display device of the embodiment to provide a storage light emitter reacting on a single-shot phenomenon while keeping a structure of a circuit therefor simplified. Also, it permits the fluorescent luminous type display device to exhibit increased luminance at a reduced voltage while being simplified in structure. Further, the fluorescent luminous type display device may be constructed at a reduced cost.

In addition, the fluorescent luminous type display device of one embodiment of the present invention includes the plural cathode electrodes 106 and the anodes arranged so as to define a matrix in cooperation with the cathode electrodes 106 and having a secondary electron emitting ratio of $\delta \geqq 1$, the plural gate electrodes 108 arranged between the phosphor layers 105 and the field electron emission materials 107, and the drive circuit for driving each of the anode electrode 104, cathode electrodes 106 and gate electrodes 108. The drive circuit feeds a predetermined signal to each of the anode electrode 104, cathode electrodes 106 and gate electrodes 108 to permit the phosphor layers 105 corresponding to all picture cells to carry out luminescence. Then, the drive circuit feeds a scanning signal to one electrodes of the gate electrodes 108 and cathode electrodes 106 and feeds an erasing signal corresponding to a display signal to the other electrodes of the gate electrodes and cathode electrodes in synchronism with the scanning signal. Such construction permits the fluorescent luminous type display device of the embodiment to provide a storage light emitter reacting on a single-shot phenomenon while keeping a structure of a circuit therefor simplified. Also, it permits the fluorescent luminous type display device to exhibit increased luminance at a reduced voltage while being simplified in structure. Further, the fluorescent luminous type display device may be constructed at a reduced cost.

The drive circuit feeds the scanning signal to the one electrodes of the gate electrodes and cathode electrodes at times corresponding to maximum display gray scales and feeds the erasing signal corresponding to display gray scales of the display signal to the other electrodes of the gate electrodes and cathode electrodes in synchronism with the scanning signal.

Also, the embodiment of the present invention may be so configured that the plural anode electrodes are arranged opposite to the one electrodes, respectively. The drive circuit includes the means for applying an anode drive signal to the anode electrodes in order prior to feeding of the scanning signal to the one electrodes and carrying out feeding of a reset signal in conformity to misregistration in timing of the anode drive signal.

Further, the present invention provides a method for driving the fluorescent luminous type display device constructed as described above.

In the first embodiment described above, the cathode electrodes are fed with the scanning signal and the gate electrode are fed with the display signal. Alternatively, the embodiment may be constructed so as to apply the scanning signal to the gate electrodes and the display signal to the cathode electrodes. Also, in each of the second to fourth embodiments described above, the gate electrodes have the scanning signal applied thereto and the cathode electrodes have the display signal applied thereto. Alternatively, the cathode electrodes and gate electrodes may be fed with the scanning signal and display signal, respectively.

As can be seen from the foregoing, the fluorescent luminous type of the present invention provides display at increased luminance or brightness while being simplified in structure.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent luminous type display device comprising:

a vacuum airtight envelope including a first insulating substrate and a second insulating substrate arranged opposite to said first insulating substrate;

at least one anode constituted by at least one anode electrode arranged on an inner surface of said first insulating substrate and at least one phosphor layer emitting secondary electrodes and laminatedly deposited on said anode electrode;

at least one cathode electrode arranged on an inner surface of said second insulating substrate and at least one field electron emission material laminatedly arranged on said cathode electrode;

at least one gate electrode arranged between said phosphor layer and said field electron emission material; and a drive circuit for driving each of said anode electrode, cathode electrode and gate electrode in response to a display signal;

said drive circuit including a means for driving said anode electrode, cathode electrode and gate electrode to cause electrons emitted from said field electron emission material to be impinged on said phosphor layer, leading to luminescence of said phosphor layer and then floating a potential at said anode electrode;

said drive circuit applying a voltage at a predetermined level between said gate electrode and said cathode electrode to maintain luminescence of said phosphor layer.

2. A fluorescent luminous type display device comprising:

a vacuum airtight envelope including a first insulating substrate and a second insulating substrate arranged opposite to said first insulating substrate;

at least one anode constituted by at least one anode electrode arranged on an inner surface of said first insulating substrate and at least one phosphor layer emitting secondary electrons and laminatedly deposited on said anode electrode;

a plurality of cathode electrodes arranged on an inner surface of said second insulating substrate and a plurality of field electron emission materials laminatedly arranged on said cathode electrodes;

at least one gate electrode arranged between said phosphor layer and said field electron emission materials so as to define a matrix in cooperation with said cathode electrodes; and a drive circuit for driving each of said anode electrode, cathode electrodes and gate electrode;

said drive circuit including a means for feeding a luminescence drive signal to said anode electrode for a predetermined period of time, feeding a scanning signal to one of said gate electrode and cathode electrodes for said predetermined period of time and feeding a luminescence drive signal to the other of said gate electrode and cathode electrodes in synchronism with said scanning signal.

3. A fluorescent luminous type display device comprising:

a vacuum airtight envelope including a first insulating substrate and a second insulating substrate arranged opposite to said first insulating substrate;

at least one anode constituted by at least one anode electrode arranged on an inner surface of said first insulating substrate and at least one phosphor layer emitting secondary electrons and laminatedly deposited on said anode electrode;

a plurality of cathode electrodes arranged on an inner surface of said second insulating substrate and a plurality of field electron emission materials laminatedly arranged on said cathode electrodes;

a plurality of gate electrodes arranged between said phosphor layer and said field electron emission materials so as to define a matrix in cooperation with said cathode electrodes; and a drive circuit for driving each of said anode electrode, cathode electrodes and gate electrodes;

said drive circuit including a means for feeding a predetermined signal to said anode electrode, cathode electrodes and gate electrodes to carry out luminescence of said phosphor layer corresponding to all picture cells, and then carrying out feeding of a scanning signal to one electrodes of said gate electrodes and cathode electrodes and feeding of an erasing signal corresponding to a display signal to the other electrodes of said gate electrodes and cathode electrodes in synchronism with said scanning signal.

4. A fluorescent luminous type display device as defined in claim 3, wherein said drive circuit feeds said scanning signal to said one electrodes at times corresponding to maximum display gray scales and feeds said erasing signal corresponding to display gray scales of the display signal to said the other electrodes in synchronism with said scanning signal.

5. A fluorescent luminous type display device as defined in claim 3, wherein a plurality of said anode electrodes are arranged;

said anode electrodes each are arranged opposite to said one electrodes, respectively; and said drive circuit includes a means for applying an anode drive signal to said anode electrodes in order prior to feeding of said scanning signal to said one electrodes and carrying out feeding of a reset signal in conformity to misregistration in timing of said anode drive signal.

6. A fluorescent luminous type display device as defined in any one of claims 1 to 5, wherein said anode contains a secondary electron emission material capable of emitting secondary electrons therefrom.

7. A fluorescent luminous type display device as defined in claim 6, wherein said secondary electron emission material contains at least one selected from the group consisting of BiO, PbO, MgO, SbO and SnO.

8. A fluorescent luminous type display device comprising:

a vacuum airtight envelope including a first insulating substrate and a second insulating substrate arranged opposite to said first insulating substrate;

at least one anode constituted by at least one anode electrode formed on an inner surface of said first insulating substrate and at least one phosphor layer laminatedly formed on said anode electrode;

at least one cathode electrode arranged on an inner surface of said second insulating substrate and at least one field electron emission material laminatedly arranged on said cathode electrode; and at least one gate electrode arranged between said phosphor layer and said field electron emission material;

said anode containing a secondary electron emission material capable of emitting secondary electrons therefrom.

9. A fluorescent luminous type display device as defined in claim 8, wherein said secondary electron emission material contains at least one selected from the group consisting of BiO, PbO, MgO, SbO and SnO.

* * * * *

UNITED STATES PATENT AND TRADEMARK OFFICE

CERTIFICATE OF CORRECTION

PATENT NO. : 6,356,030 B2
DATED : March 12, 2002
INVENTOR(S) : Itoh et al.

It is certified that error appears in the above-identified patent and that said Letters Patent is hereby corrected as shown below:

Title page,
Item [30], the Foreign Application Priority information should read:
-- [30] Foreign Application Priority Data
Dec. 28, 1999 (JP) ..... 11-373719

Signed and Sealed this

First Day of October, 2002

*Attest:*

*Attesting Officer*

JAMES E. ROGAN
*Director of the United States Patent and Trademark Office*